United States Patent [19]

Kryter

[11] Patent Number: 4,921,660

[45] Date of Patent: May 1, 1990

[54] GOLF CLUB WITH STROKE GUIDING DEVICE

[75] Inventor: Karl D. Kryter, Borrego Springs, Calif.

[73] Assignee: Acousis Company, Borrego Springs, Calif.

[21] Appl. No.: 380,669

[22] Filed: Jul. 17, 1989

[51] Int. Cl.[5] ..... A63B 69/36

[52] U.S. Cl. ..... 273/164; 273/194 A

[58] Field of Search ..... 273/164, 183 D, 186 A, 273/186 C, 162 R, 162 E, 163 R, 163 A, 194 R, 194 A, 194 B

[56] References Cited

U.S. PATENT DOCUMENTS

| | | | |
|---|---|---|---|
| 1,644,392 | 10/1927 | Myers | 273/186 A |
| 2,670,209 | 2/1954 | Fay | 273/183 D |
| 3,951,415 | 4/1976 | Stuart | 273/183 D |
| 4,034,989 | 7/1977 | Stewart | 273/164 |
| 4,167,268 | 9/1979 | Lorang | 273/163 A |
| 4,629,193 | 12/1986 | Pierman | 273/183 D |
| 4,720,109 | 1/1988 | Kryter | 273/164 |

*Primary Examiner*—George J. Marlo
*Attorney, Agent, or Firm*—Victor R. Beckman

[57] ABSTRACT

A golf guide for a golf club is shown which includes an obtuse isosceles triangular shaped member comprising visible line segments. The guide is attached to the golf club with the vertex of the triangular shaped member located at a point on a vertical plane that is normal to the ball-striking surface of the head of the club at the sweet-spot. The base leg of the triangular shaped member opposite the vertex is located parallel to, and foward of, the ball-striking surface of the head. A second obtuse isosceles triangular shaped member also comprising visible line segments may be attached to the golf club with the vertex located at a point on the plane and with the base leg parallel with the base leg of the first triangular shaped member and located rearwardly of the rear face of the club head.

13 Claims, 4 Drawing Sheets

GOLF CLUB WITH STROKE GUIDING DEVICE

FIELD OF THE INVENTION

This invention relates to guide means which may be made a part of, or attached to, a golf club that enhances the ability of the player to develop and use a club stroke such that the sweet spot of the striking surface of the club blade and the orientation of the blade cause the ball to follow an intended path line when struck.

BACKGROUND OF THE INVENTION

Aids for improving a player's golf stroke are well known. One type of aid shown in U.S. Pat. No. 4,720,109 by the present inventor includes a pair of relatively unobtrusive, thin, visible line segments which together form at least portions of opposite arms of a V-shape, and which is attached to a golf club with at least portions of the line segments extending forwardly of the plane of the ball-striking surface at a height above the bottom surface of the club head that is greater than the diameter of a golf ball to allow striking of the golf ball by the striking surface. The intersection of the line segments is located in a plane that is normal to the ball-striking surface of the head at the sweet-spot. Such an arrangement is particularly well adapted to assist the player in striking the ball at the sweet-spot.

In U.S. Pat. No. 4,167,268, guide means shown in FIG. 12 include substantially horizontally extending arms 51 and 52 between which the head of the golf club is viewed. The arms extend parallel with the putting face of the club, and when the club is not stroked on a straight line, they visually describe dis-similar spacing on the line of sight from the eye of the golfer advising the golfer that his stroke is not along a straight line path. Other types of aids include an arrow-type pointer for use in pointing the club head in the direction of the hole. Typical aids of this type are shown in U.S. Pat. Nos. 3,033,574; 3,198,525; 3,298,693; 3,292,928; 3,529,830; 3,667,761; 4,053,160; Des. 111,855; Des. 150,497; and Des. 188,677. In other arrangements the arrow-type pointer is included in a structure which includes an opening through which the golf ball is viewed when the club engages the ball. U.S. Pat. Nos. 2,670,209 and 4,002,343 show aids of this type.

Sighting devices which attach to the club shaft a spaced distance from the club head are shown in U.S. Pat. Nos. 2,898,109 and 3,951,415. Devices which attach lo the club face are shown in U.S. Pat. Nos. 3,489,415; 4,025,078; 4,130,282 and 4,323,246. Many prior art guides do not readily provide cognitive information relative both to the exact lateral location of the sweet-spot on the striking surface of the club head, and the club orientation, prior to, at the moment of, and following impact of the head of the club with the ball.

OBJECTS AND SUMMARY OF THE INVENTION

An object of this invention is the provision of improved guide means which is attached to a golf club to aid the golfer in properly stroking the ball.

An object of this invention is the provision of guide means of the above-mentioned type that include relatively unintrusive line segments which provide stroke-guidance information when brought into the visual field occupied by the golf ball.

The above and other objects and advantages of this invention are achieved by guide means attached to the club and comprising three visible line segments in the form of an isosceles triangle. At least parts of the equal length side legs of the triangular-shaped guide means and the interconnecting base leg thereof are located ahead of the striking surface of the club, with the vertex of the equal length side legs located on a vertical plane that is normal to the striking surface of the club and extending through the sweet-spot of the blade of the club. The base leg of the triangular-shaped guide means extends parallel to the striking surface of the club to provide the golfer with advance information about the motion and angle of the striking surface of the club as the blade is advanced toward the ball during the downswing. This advanced information allows a greater period of time to anticipate and make slight adjustments in the orientation of the club so that the striking surface is correctly angularly oriented at the moment of impact with the ball. The equal-length legs of the triangular-shaped guide are used to guide the golfer in striking the ball at the sweet-spot of the striking surface of the club blade. If desired, the guide means may include a second triangular-shaped unit extending rearwardly of the club head to provide the golfer with advanced information concerning the orientation of the club head as the club head is moved rearwardly away from the ball during the back swing. The guide means may be supported on brackets equally spaced laterally from said vertical plane that is normal to the sweet-spot of the blade of the club. The brackets may comprise, or may be provided with visible line segments that extend parallel to said plane to provide further visual guidance to the golfer.

BRIEF DESCRIPTION OF THE DRAWINGS

The invention, together with other objects and advantages thereof, will be better understood from the following description when considered with the accompanying drawings. In the drawings, wherein like reference characters refer to the same parts in the several views.

Figure 1:
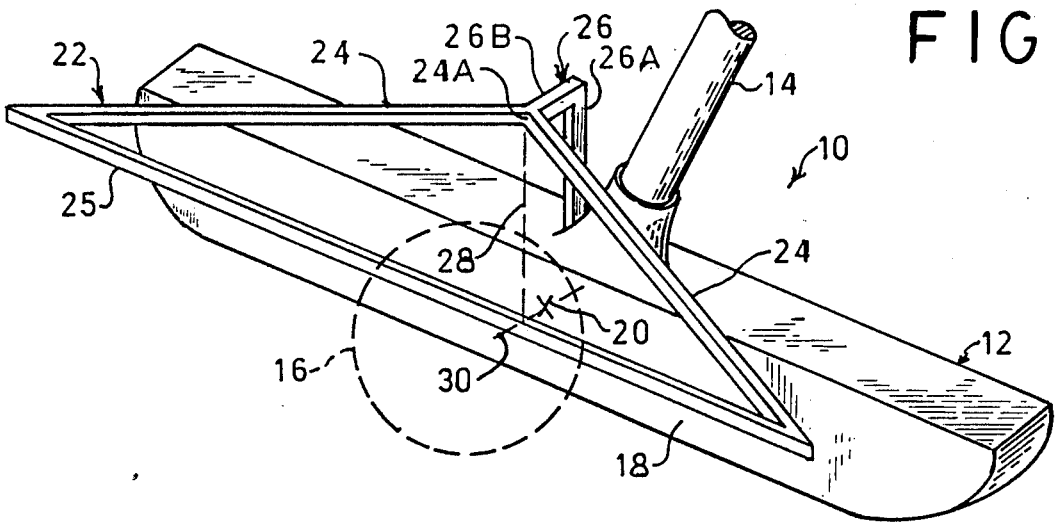
FIG. 1 is a fragmentary perspective view of a golf club showing guide means having a generally triangular-shape attached thereto, which guide means embodies the present invention.

Reference first is made to FIG. 1 wherein there is shown a golf club 10 which includes a club head, or blade, 12 and shaft 14. Although, for purposes of illustration, a putter is shown, it w ill be understood that the guide means of this invention may be used with other golf clubs. A golf ball 16 is shown in broken lines adjacent the striking surface 18 of the club head. Reference numeral 20 identifies the sweet-spot on the striking surface of the club head; the location of the sweet-spot being identified by the letter X on the striking surface. Sweet-spot 20 identifies the exact balance-point of the club head, at which point ball 16 is best to be struck if an accurate shot is to be made. Putters may be provided with a marker or markers on the top surface of the head behind the location of the sweet-spot.

Novel guide means 22 embodying the present invention are attached to the club, which guide means comprise three line segments 24,24 and 25 which form an obtuse isosceles triangular shape. Line segments 24,24 comprise equal length side legs, and line segment 25 comprises the interconnecting base leg of the triangular shaped guide means. The illustrated line segments comprise slender, elongated, members which may be formed of metal, plastic, fibrous materials, or the like. A bracket 26 attaches the line segments to the golf club which, in the illustrated arrangement, comprises an inverted L-shaped member that includes a vertical section 26A and a horizontal section 26B extending forwardly from the vertical section. The bottom of bracket section 26A is secured to the club head by any suitable means. Line segments 24,24 are attached to the forward end of horizontal bracket section 26B at the vertex 24A of the triangular shaped guide means. Point 24A is located in a vertical plane that is normal to the striking surface 18 of the club head at the sweet-spot 20, which plane bisects triangular shaped guide means 22. In FIG. 1, broken line 28 is shown extending vertically downward from point 24A, and broken horizontal line 30 is shown extending forwardly and rearwardly from the sweet-spot 20, which lines lie in, and define, the vertical plane that is normal to the striking surface 18 and extending through the sweet-spot 20.

From the above, it will be seen that point 24A at the vertex of the triangular shaped guide means is located on a plane that is normal to the striking surface 18 and that extends through the sweet-spot 20. Vertex 24A may be located forwardly, rearwardly, or on the plane of the ball striking surface 18 and in FIG. 1 for purposes of illustration, but not by way of limitation, it is shown located forwardly of the plane of ball striking surface 18. Each equal length line segment 24 extends forwardly from and obliquely transverse relative to the striking surface 18 and, as noted above, they extend in different directions laterally from a point on the vertical plane that is normal to the striking surface 18 and extends through the sweet-spot 20. The three line segments 24,24 and 25 are positioned by bracket 26 above the bottom ground-facing surface of the club head at a height that is greater than the diameter of golf ball 16. In this and other embodiments of the invention at least a portion of the golf ball is visible through the triangular guide means when the ball is engaged with the sweet-spot of the ball-striking surface.

When initiating a golf shot, a golfer visualizes a direction line it is wished the ball to follow after being struck by the blade of the club. It is important for accuracy that the ball be struck on the sweet-spot of the club face. Otherwise, the ball will tend to be pushed or pulled, somewhat from the direction line intended for the ball, and may not travel as far as it otherwise would. Also, it is important that the striking surface 18 be normal to the path of travel of the club head at the moment of impact with the ball. The present invention permits the golfer to concentrate his or her focus on the ball lying on the ground and, at the same time brings into the visual field occupied by the golf ball, thin, relatively unobtrusive, line segments 24,24 that converge symmetrically toward the golf ball when the sweet-spot of the club head is exactly in line with the ball as the club head approaches the ball. Simultaneously, line segment 25 of the triangular shaped guide means provides the golfer with advance information about the angle of the striking surface 18 of the club as the blade is advanced toward the ball during the downswing allowing greater time to anticipate and make slight adjustments in the orientation of the club prior to impact with the ball. With this advance information, the striking surface may be correctly angularly oriented at the moment of impact with the ball. In short, the plane defined by lines 28 and 30 in FIG. 1, should lie in the desired path of the ball 16 and, if it does not, this fact is made readily apparent to the golfer simply by observing the orientation of the triangular shaped line segments 24,24 and 25 relative to the desired path.

Figure 2:
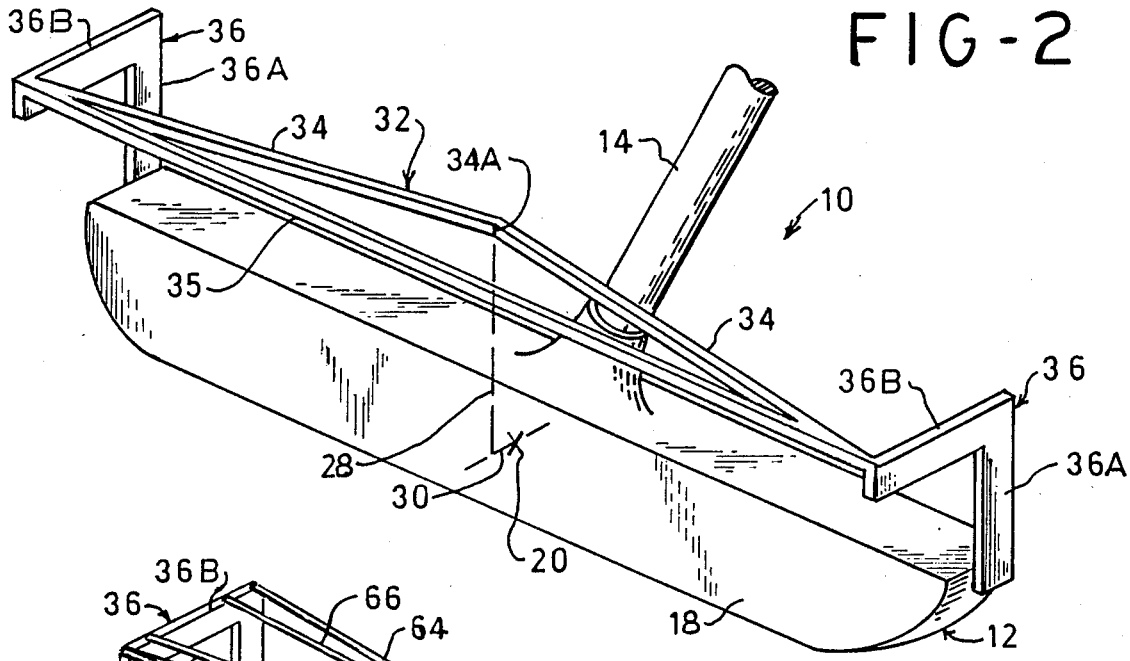
FIG. 2 is a fragmentary perspective view of a golf club and showing a modified form of triangular-shaped guide means attached to the club.

Reference now is made to FIG. 2 wherein a modified form of guide member is shown identified by reference numeral 32 that includes three visual line segments 34,34 and 35 which form an obtuse isosceles triangular shape. As with the arrangement of FIG. 1, the line segments 34,34 and 35 comprise relatively unobtrusive, slender, elongated members. Line segments 34, 34 comprise equal length side legs of the triangle, and line segment 35 comprises the base of the triangle. The vertex 34A of the triangle is located in a vertical plane that is normal to the striking surface 18 of the club head 12 and extending through the sweet-spot 20. The line segments are supported adjacent opposite ends of base leg 35 by brackets 36,36 attached to the club head at the opposite ends thereof. Each bracket includes a vertical upright section 36A and a forwardly extending horizontal section 36B. As with the arrangement of FIG. 1, the triangular shaped line segments 34,34 and 35 function to aid the golfer in striking the golf ball at the sweet-spot and at the same time provide advanced information concerning the angle between the striking surface 18 of the club head and the desired line of travel of the golf ball.

As viewed from above, horizontal sections 36B of brackets 36,36 comprise visual line segments at opposite ends of the club head that are equi-distant from the sweet-spot 20 and extend forwardly of the striking face 18. In the illustrated arrangement, line segments 36B, 36B are parallel to each other and to the plane identified by lines 28 and 30. These line segments also provide stroke guidance information to the golfer. Line segments 36B, 36B need not extend parallel to each other but, instead, may be positioned along converging lines, with the angle between the line segment extended and the vertical plane through the sweet-spot being the same for both line segments.

Figure 3:
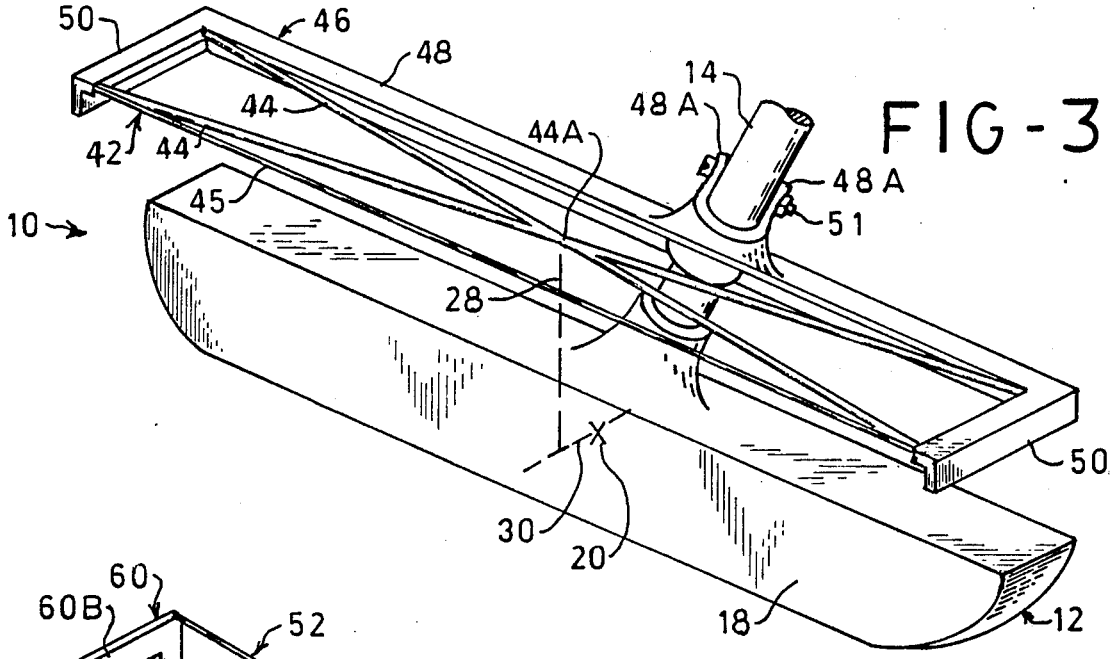
FIG. 3 is a fragmentary perspective view of a golf club showing a modified form of guide means, wherein the side legs of the triangular shaped member extend rearwardly from the vertex of the triangle to form a generally X-shape with the side legs of the triangular shaped guide means.

If desired, the equal length line segments of the triangular shaped guide means, such as line segments 24,24 of FIG. 1 and line segment 34,34 of FIG. 2 may be extended rearwardly from the vertices 24A and 34A, respectively. Referring to FIG. 3, a guide member 42 is shown comprising a pair of intersecting line segments 44,44, together with a leading base leg 45 extending parallel to striking surface 18. It here will be noted that portions of the line segments forward of the point 44A at which line segments 44,44 intersect correspond, essentially, to the triangular shaped guide means 32 shown in FIG. 2. Support for guide means 42 on the golf club is provided by a U-shaped bracket 46 comprising a transverse member 48 and a pair of forwardly-extending arms 50,50 at opposite ends thereof, which arms are located equal distances from the vertical plane containing lines 28 and 30 and sweet-spot 20 at the striking surface 18. Transverse arm 48 is formed with a pair of laterally spaced arcuate legs 48A,48A for removably gripping shaft 14 of the golf club. A threaded fastener 51 extends through apertures at the free ends of legs 48A,48A for securely clamping guide means 46 to the golf club.

Line segments 44, 44 extend from the forward ends of arms 50,50 obliquely transversely to the rear ends thereof. They may comprise rigid members, such as line segments 24,24 and 34, 34 of the FIG. 1 and FIG. 2 embodiments, or they may comprise strings, or wires, since they are anchored at their opposite ends. The point 44A of intersection of line segments 44,44, is located in a vertical plane that is normal to the striking surface 18 of the club head 12 and extending through the sweet-spot 20. Again, vertical and horizontal lines 28 and 30 in FIG. 3 define such a plane. Portions of line segments 44,44 located rearwardly of intersection point 44A provide the golfer with additional visual information concerning the orientation of the striking surface 18 relative to the path of travel of the club head. If the striking surface is not normal to said path, this fact is readily noted by observation of the line segments 44,44 and 45 of guide means 42. Also, as with the FIG. 2 arrangement, line segments provided by horizontal arms 50,50 at opposite sides of the sweet-spot 20 provide the golfer with additional visual information concerning the orientation of the club head relative to the path of travel thereof.

Figure 4:
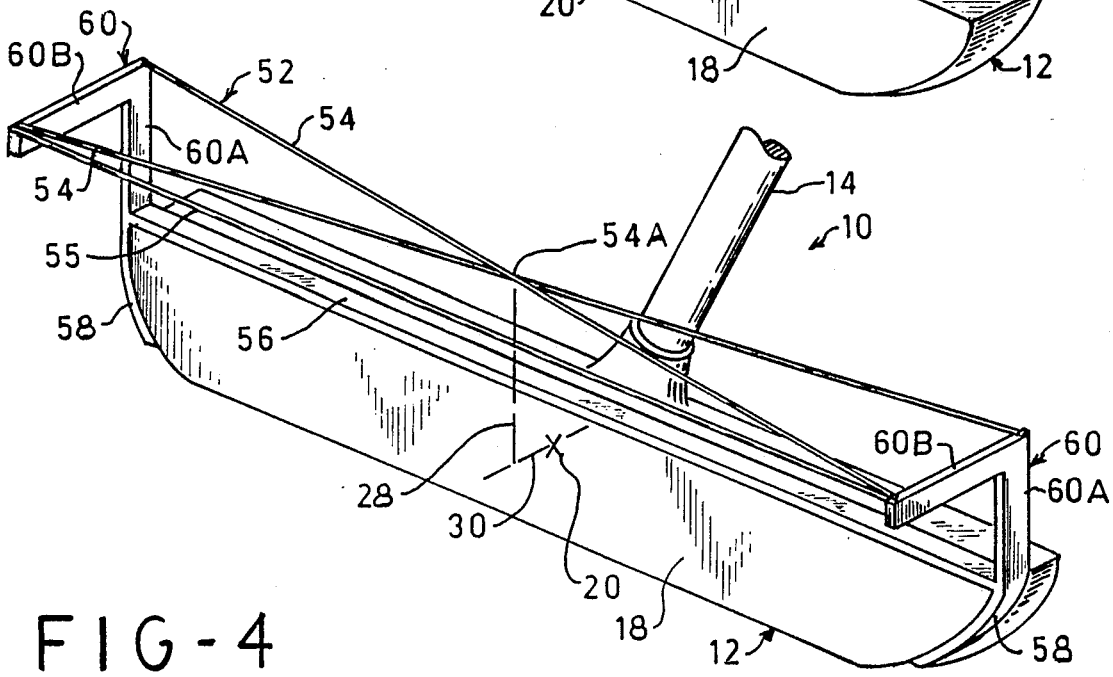
FIG. 4 is a fragmentary perspective view of a golf club showing a modified form of guide means which is similar to that shown in FIG. 3.

Reference now is made to FIG. 4 that shows a guide means 52 which includes a pair of intersecting line segments 54,54 in an X-shape form together with a leading base leg 55 extending parallel to striking surface 18, which guide means is similar to that of FIG. 3. It will be seen that the ends of line segments 54,54 forward of intersection 54A, together with line segment 55 define an isosceles triangle in the manner of the FIG. 3 embodiment. Guide means 52 is removably attached to the club head 12 rather than to the club shaft 14. It includes a transverse web 56 having downwardly extending arcuate legs 58,58 at opposite ends thereof. Web 56 engages the upper surface of the club head, and the arcuate legs 58,58 engage the ends of the club head and extend for a short distance along the bottom surface thereof. The guide means may be made of rigid, yet slightly resilient material so as to firmly grip the club head when attached thereto.

Brackets 60,60 are provided at opposite ends of the web 56, each of which includes an upwardly-directed arm 60A and forwardly-directed arm 60B at the upper end of arm 60A. Line segments 54,54 and 55 are attached to the arms 60B, 60B, with the point of intersection 54A of line segments 54,54 located in a vertical plane normal to the striking surface 18 and extending through the sweet-spot 20. Also, as in other arrangements, horizontal ar ms 60B, 60B may comprise visual line segments for aiding the golfer's swing.

Figure 5:
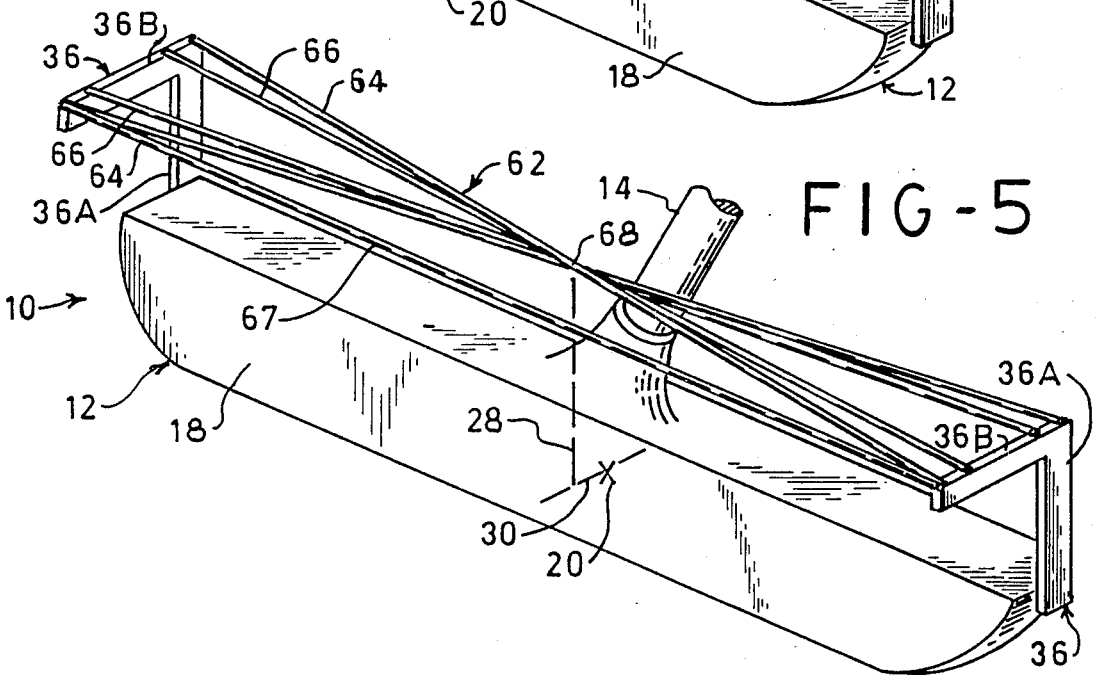
FIG. 5 is a fragmentary perspective view of a golf club showing another modified form of guide means which is similar to that of FIG. 4 but which includes an additional X-shaped means.

If desired, the guide means of this invention may include in addition to the line segments defining a triangle, a plurality of V-shaped, or X-shaped, line segments, which converge, or intersect, in the vertical plane which is normal to the striking surface and passes through the sweet-spot thereon. One such arrangement is shown in FIG. 5 wherein the head 12 of golf club 10 is shown provided with inverted L-shaped brackets 36,36 of the same type shown in FIG. 2 and described above. Guide means 62 in the form of first and second pairs of intersecting line segments 64,64 and 66,66, respectively, and transverse base line segment 67 are attached to the horizontal arm portions 36B, 36B of brackets 36,36. The X-shape formed by line segments 66,66 is located inside that formed by line segments 64,64, and line segments 64,64 and 66, 66 intersect at point 68 which is located in a plane normal to the striking surface and extending through sweet-spot 20. Line segment 67 together with portions of line segments 64,64 forward of intersection 68 comprise an isosceles triangular guide means for visual guidance in the manner described above. Line segments 66,66 inside line segments 64,64 provide additional visual guidance to the golfer. As in other arrangements wherein the line segments are supported at opposite ends, they may comprise wire, flexible lines, or the like that extend between brackets 36, rather than rigid segments.

Figure 6:
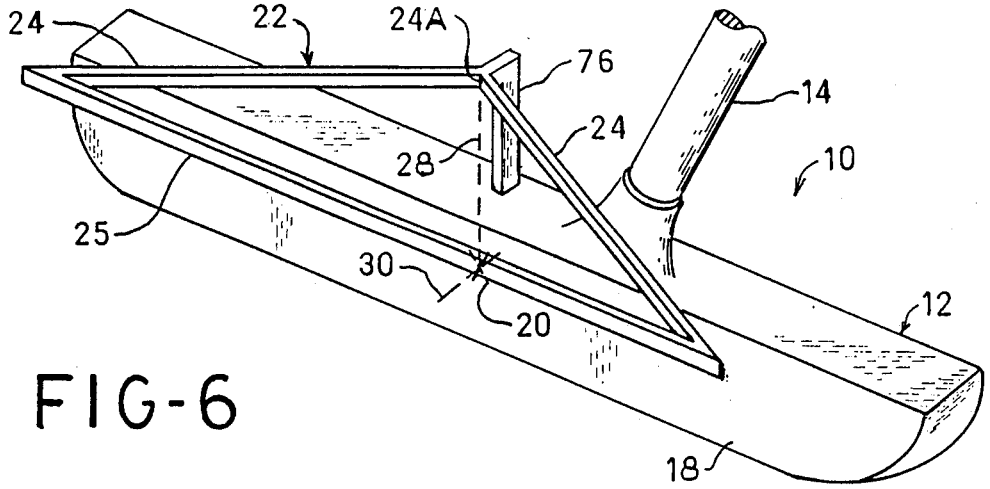
FIG. 6 is a fragmentary perspective view of a golf club showing a modified form of triangular shaped guide means wherein the vertex thereof is located in the plane of the ball striking surface of the club head.

As noted above the vertex of the triangular shaped guide means may be located forwardly, rearwardly, or on the plane of the ball striking surface 18. In FIG. 6, to which figure reference now is made, the vertex 24A of the triangular shaped guide means 22 is shown located in the plane of the ball striking surface 18. Guide means 22 of the same type as shown in FIG. 1 is employed in the FIG. 6 arrangement, which guide means includes line segments 24,24 and 25 which form a triangular shape. An inverted L-shaped bracket 76 attaches the line segments to the club head such that the vertex 24A of the triangular shaped guide means is located directly above sweet-spot 20. In FIG. 6, broken line 28 which extends vertically downwardly from vertex 24A is seen to intersect horizontal broken line 30 at the sweet spot 20.

Figure 7:
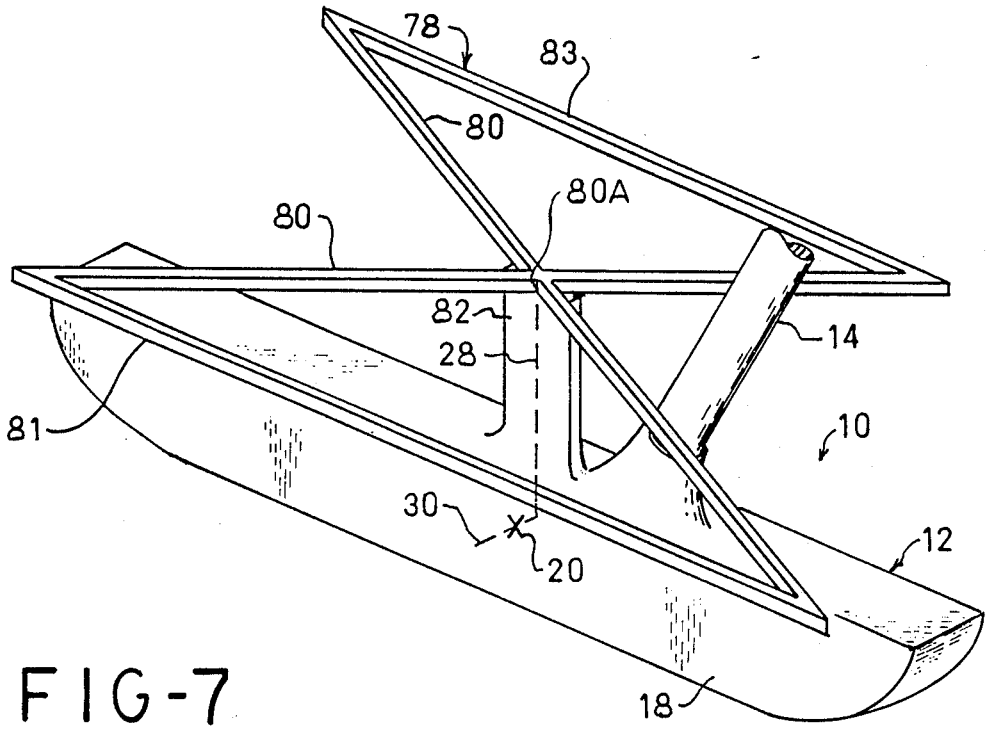
FIG. 7 is a fragmentary perspective view of a golf club showing a modified form of double triangular shaped guide means wherein the base members of the triangles are located forwardly and rearwardly of the respective front and rear surfaces of the club head, and the vertices are located directly over the club head rearwardly of the sweet-spot.

In FIG. 7 to which reference now is made, guide means 78 is shown comprising a pair of intersecting line segments 80,80, which intersect at point 80A, together with forward and transverse base members 81 and 83, respectively. The forward extending portions of line segments 80,80, together with line segment 81, comprise a first triangular guide element for use during the downswing whereas the rearwardly extending portions of line segments 80,80, together with line segment 83, comprise a second triangular guide element for use during the backswing. Support of the guide means is provided by a bracket 82 extending upwardly from the top of the golf club 10. The vertex 80A of the two isosceles triangles is located in a vertical plane that is normal to the striking surface 18 of the club head 12 and extending through the sweet-spot 20. As above, vertical and horizontal lines 28 and 30 define such a plane. As seen in FIG. 7, point 80A is located rearwardly of the plane of the ball striking surface 18. Line segment 81 is located forwardly of the plane of the ball striking surface to provide the golfer with advanced information concerning the angle between the ball striking surface and the desired line of travel of the golf ball, and line segment 83 is located rearwardly of the plane of the rear of the club head to provide the golfer with advance information during the backswing. If desired, the rear of the club may be provided with a ball striking surface to Permit both right and left hand use of the club.

Figure 8:
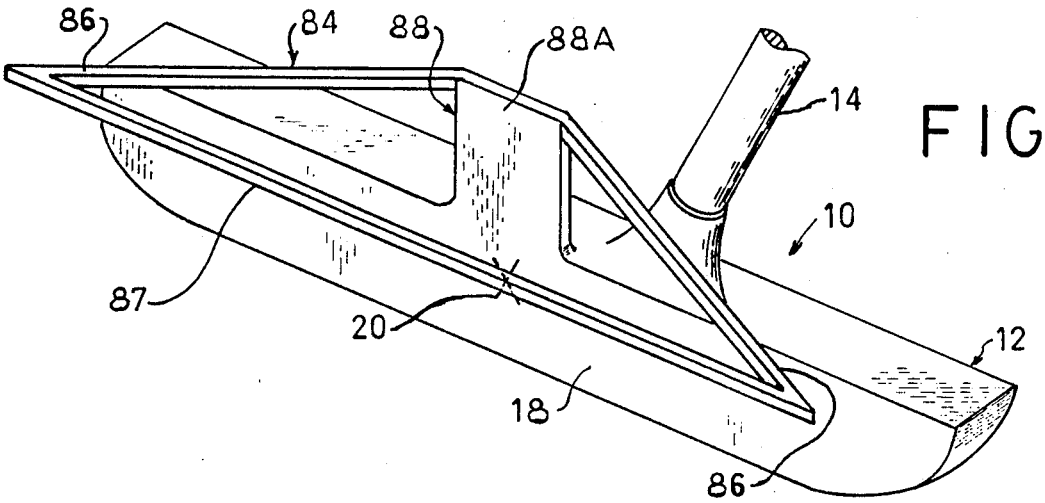
FIG. 8 is a fragmentary perspective view of a golf club showing a modified form of guide means wherein the guide means is of a truncated triangular shaped form.

If desired, the triangular shaped guide means may be truncated to some degree without materially reducing the affectiveness of the guide means. Reference is made to FIG. 8 wherein guide means 84 is shown comprising line segments 86,86 and 87 carried by bracket 88 attached to the club head 12. In the illustrated arrangement, the front face 88A of bracket 88 lies in the plane of the ball striking surface 18, and line segments 86,86 extend forwardly from and obliquely transverse relative to the plane of the ball striking surface. The interconnecting base member 87 extends parallel to the plane of the striking surface. The top surface of bracket 88 together with the line segments 86,86 and 87 provide for a generally truncated triangular shaped visual guide means. Again, the truncated triangular shaped guide means provides the golfer with advanced information concerning the angle between the ball striking surface and the desired line of travel of the golf ball.

Figure 9:
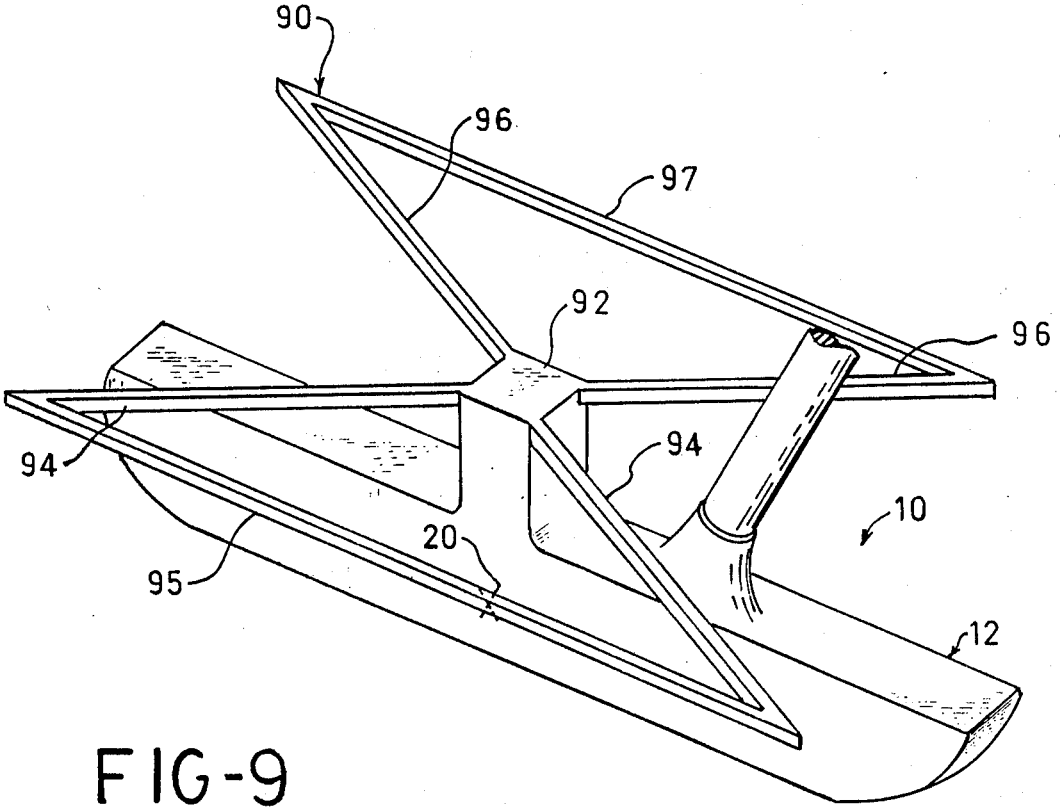
FIG. 9 is a fragmentary perspective view of a golf club showing another modified form of guide means which is similar to that shown in FIG. 7 but employing truncated triangular shaped elements.

Reference now is made to FIG. 9 wherein guide means 90 is shown attached to club head 12 by an upwardly extending bracket 92. Guide means 90 includes a first truncated triangular shaped element comprising forwardly extending line segments 94,94 and base line segment 95, and a second truncated triangular shaped element comprising rearwardly extending line segments 96,96 and base line segment 97. Elements 94,94 and 96,96 extend from the corners of the bracket 92. The forwardly positioned line segments 94,94 and 95, corresponding to line segments 86,86, and 87 of the FIG. 8 arrangement, and provide the golfer with advance information concerning the downstroke of club head. The rearwardly positioned line segments 96,96 and 97 provide the golfer with advance information concerning the backstroke of the club head. Also, as with the FIG. 7 arrangement, the rear of the club head may be provided with a golf-striking surface thereby adapting the club for either right or left hand use.

It here will be noted that at least a portion of a golf ball at the sweet-spot of the ball-striking surface is visible between the forwardly positioned visible line segments of the triangular shaped guide means of this invention.

From the above it will be apparent that the guide means may be of very light weight such that the golf club handles substantially the same with or without the guide means attached thereto. Consequently, after learning to properly stroke the club while using the guide means, the golfer may continue employing proper stroking when using a golf club without the guide means.

The invention having been described in detail in accordance with requirements of the Patent Statutes, various other changes and modifications will suggest themselves to those skilled in this art. For example, visible line segments may comprise light beams wherein collimated beams of light are directed along the desired paths to provide a triangular shaped guide. If desired, thin bright colored lines may be painted or otherwise formed on the illustrated guide means longitudinally thereof to provide for line segments of increased visibility. Alternatively, the guide means may comprise a clear transparent sheet supported above the club head upon which line segments are painted, etched, or otherwise formed. In all of the embodiments, the visible line segments comprise straight line segments. Obviously, curved visible line segments may be employed if desired. Also, the base leg of the triangle could be extended beyond the corners of the triangles if desired. It is intended that the above and other such changes and modifications shall fall within the spirit and scope of the invention recited in the following claims.

I claim:

1. In combination with a golf club having an upwardly extending shaft and a head at the lower end of the shaft which head includes a bottom surface and a substantially flat ball-striking surface having a sweet-spot, guide means comprising at least first, second and third relatively unobtrusive, thin, visible line segments which together form at least a portion of an isosceles triangle shape, said first and second line segments being of equal length and defining equal length side legs of the triangle, said third line segment interconnecting said first and second line segments and defining a base leg of the triangle, means for attaching said guide means to the golf club with the third line segment extending parallel to the ball-striking surface of the club and forward of the plane of the ball-striking surface and at a height above the bottom surface of the club head that is greater than the diameter of a golf ball to allow striking of the golf ball by the striking surface, said first and second line segments being located at opposite sides of a vertical plane that is normal to the ball-striking surface and extending through the sweet spot, at least a portion of a golf ball at the sweet-spot of the ball-striking surface being visible between the first, second and third line segments as viewed from above.

2. The combination as defined in claim 1 wherein said means for attaching said guide means to the golf club comprises a bracket attached to the club head intermediate opposite ends thereof to which bracket said pair of line segments are attached.

3. The combination as defined in claim 1 wherein said means for attaching said guide means to the golf club includes brackets attached to the golf club laterally of said vertical plane at equally spaced distances therefrom, and means for attaching said visual line segments to said brackets.

4. The combination as defined in claim 1 wherein said guide means are non-detachably attached to the golf club.

5. The combination as defined in claim 1 wherein aid guide means are removably attached to the golf club.

6. The combination as defined in claim 1 wherein said visible line segments comprise straight line segments.

7. The combination as defined in claim 1 wherein the third line segment is of greater length than said first and second line segments to provide for an obtuse isosceles triangular shaped guide means.

8. The combination as defined in claim 1 including fourth, fifth and sixth relatively unobtrusive, thin, visible line segments which together form at least a portion of an isosceles triangle shape, said fourth and fifth line segments being of equal length and defining equal length side legs of the triangle, said sixth line segment interconnecting said fourth and fifth line segments and defining a base leg of the triangle, means for attaching said fourth, fifth and sixth line segments to the golf club with the sixth line segment extending parallel to the ball-striking surface of the club and rearward of the rear of the club head.

9. The combination as defined in claim 1 wherein the intersection of the first and second line segments defines the vertex of the triangular shaped guide means, said vertex being located in said vertical plane at a point therein forward of the plane of the ball-striking surface such that said vertex directly overlies a golf ball located at the sweet-spot.

10. The combination as defined in claim 1 wherein the intersection of the first and second line segments defines the vertex of the triangular shaped guide means, said vertex being located in said vertical plane at a point on the plane of the ball-striking surface.

11. The combination as defined in claim 1 wherein the intersection of the first and second line segments defines the vertex of the triangular shaped guide means, said vertex being located in said vertical plane at a point therein rearward of the ball-striking surface.

12. In combination with a golf club having an upwardly extending shaft and a head at the lower end of the shaft which head includes a bottom surface and a substantially flat ball-striking surface having a sweet-spot, guide means comprising, an isosceles triangular shaped member comprising visible line segments in the shape of a triangle having a vertex and opposite base leg, means for attaching said guide means to the golf club with the vertex located at a point on a vertical plane that is normal to the ball-striking surface of the head at the sweet-spot and with the base leg extending normal to said vertical plane and located forward of the plane of the ball-striking surface, said guide means being generally horizontally positioned at a height above the bottom surface of the club head that is greater than the diameter of a golf ball to allow striking of the golf ball by the striking surface.

13. The combination as defined in claim 12 including a second isosceles triangular shaped member comprising visible line segments in the shape of a triangle having a vertex and opposite base leg, means for attaching said second triangular shaped member to the golf club with the vertex thereof located in said vertical plane that is normal to the ball-striking surface of the head at the sweet-spot and with the base leg thereof extending normal to said vertical plane and located rearward of the club head.

* * * * *